US009275633B2

(12) United States Patent
Cath et al.

(10) Patent No.: US 9,275,633 B2
(45) Date of Patent: Mar. 1, 2016

(54) CROWD-SOURCING PRONUNCIATION CORRECTIONS IN TEXT-TO-SPEECH ENGINES

(75) Inventors: Jeremy Edward Cath, Redmond, WA (US); Timothy Edwin Harris, Lafayette, CO (US); James Oliver Tisdale, III, Duvall, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 1088 days.

(21) Appl. No.: 13/345,762

(22) Filed: Jan. 9, 2012

(65) Prior Publication Data

US 2013/0179170 A1 Jul. 11, 2013

(51) Int. Cl.
*G10L 13/08* (2013.01)

(52) U.S. Cl.
CPC ..... *G10L 13/08* (2013.01)

(58) Field of Classification Search
CPC ..... G10L 13/00; G10L 13/02; G10L 13/033; G10L 13/04; G10L 13/047; G10L 13/06; G10L 13/07; G10L 13/08; G10L 13/10
See application file for complete search history.

(56) References Cited

U.S. PATENT DOCUMENTS

| | | | | |
|---|---|---|---|---|
| 7,630,898 | B1 * | 12/2009 | Davis et al. | 704/266 |
| 2005/0131674 | A1 * | 6/2005 | Aizawa | 704/9 |
| 2005/0209854 | A1 * | 9/2005 | Abrego et al. | 704/252 |
| 2006/0106618 | A1 | 5/2006 | Racovolis et al. | |
| 2007/0016421 | A1 * | 1/2007 | Nurminen et al. | 704/260 |
| 2007/0288240 | A1 * | 12/2007 | Huang et al. | 704/260 |
| 2008/0069437 | A1 * | 3/2008 | Baker | 382/159 |
| 2008/0086307 | A1 * | 4/2008 | Okayama et al. | 704/260 |
| 2008/0208574 | A1 * | 8/2008 | Chen et al. | 704/221 |
| 2009/0006097 | A1 * | 1/2009 | Etezadi et al. | 704/260 |
| 2009/0018839 | A1 * | 1/2009 | Cooper et al. | 704/260 |
| 2009/0204402 | A1 * | 8/2009 | Marwaha et al. | 704/260 |
| 2009/0281789 | A1 * | 11/2009 | Waibel et al. | 704/3 |
| 2010/0153115 | A1 * | 6/2010 | Klee et al. | 704/260 |
| 2010/0211376 | A1 * | 8/2010 | Chen et al. | 704/2 |
| 2011/0098029 | A1 | 4/2011 | Rhoads et al. | |
| 2011/0151898 | A1 | 6/2011 | Chandra et al. | |
| 2011/0250570 | A1 * | 10/2011 | Mack | 434/169 |
| 2011/0282644 | A1 * | 11/2011 | Chin et al. | 704/2 |
| 2011/0307241 | A1 * | 12/2011 | Waibel et al. | 704/2 |
| 2012/0016675 | A1 * | 1/2012 | Hopkins et al. | 704/260 |
| 2013/0231917 | A1 * | 9/2013 | Naik | 704/9 |
| 2014/0122081 | A1 * | 5/2014 | Kaszczuk et al. | 704/260 |
| 2014/0222415 | A1 * | 8/2014 | Legat | 704/8 |

OTHER PUBLICATIONS

"How to Correct Text to Speech Pronunciation Errors", Retrieved at <<http://www.text2go.com/pronunciationtutorial.aspx>>, Retrieved Date: Oct. 21, 2011, pp. 8.
"Write like a pro with Ginger's text correction and text-to-speech online", Retrieved at <<http://www.gingersoftware.com/text-to-speech-online>>, Retrieved Date: Oct. 21, 2011, pp. 2.
"Classic Text To Speech Engine", Retrieved at <<http://www.ap-pbrain.com/app/classic-text-to-speech-engine/com.svox.classic>>, Retrieved Date: Oct. 21, 2011, pp. 3.
"Babylon Translator with stardict", Retrieved at <<http://tips-linux.net/en/linux-ubuntu/linux-software/linux-utility/babylon-translator-stardict>>, Feb. 12, 2011, pp. 2.

* cited by examiner

*Primary Examiner* — Eric Yen
(74) *Attorney, Agent, or Firm* — Kevin Sullivan; Kate Drakos; Micky Minhas

(57) ABSTRACT

Technologies are described herein for providing validated text-to-speech correction hints from aggregated pronunciation corrections received from text-to-speech applications. A number of pronunciation corrections are received by a Web service. The pronunciation corrections may be provided by users of text-to-speech applications executing on a variety of user computer systems. Each of the plurality of pronunciation corrections includes a specification of a word or phrase and a suggested pronunciation provided by the user. The pronunciation corrections are analyzed to generate validated correction hints, and the validated correction hints are provided back to the text-to-speech applications to be used to correct pronunciation of words and phrases in the text-to-speech applications.

20 Claims, 3 Drawing Sheets

CROWD-SOURCING PRONUNCIATION CORRECTIONS IN TEXT-TO-SPEECH ENGINES

BACKGROUND

Text-to-speech ("TTS") technology is used in many software applications executing on a variety of computing devices, such as providing spoken "turn-by-turn" navigation on a GPS system, reading incoming text or email messages on a mobile device, speaking song titles or artist names on a media player, and the like. May TTS engines may utilize a dictionary of pronunciations for common words and/or phrases. When a word or phrase is not listed in the dictionary, these TTS engines may rely on fairly limited phonetic rules to determine the correct pronunciation of the word or phrase.

However, such TTS engines may be prone to errors as a result of the complexity of the rules governing correct use of phonetics based on a wide range of possible cultural and linguistic sources of a word or phrase. For example, many street and other places in a region may be named using indigenous and/or immigrant names. A set of phonetic rules written for a non-indigenous or differing language or for a more widely utilized dialect of the language may not be able to decode the correct pronunciation of the street names or place names. Similarly, even when a dictionary pronunciation for a word or phrase is available in the desired language, the pronunciation may not match local norms for pronunciation of the word or phrase. Such errors in pronunciation may impact the user's comprehension and trust in the software application.

It is with respect to these considerations and others that the disclosure made herein is presented.

SUMMARY

Technologies are described herein for providing validated text-to-speech correction hints from aggregated pronunciation corrections received from text-to-speech applications. Utilizing the technologies described herein, crowd sourcing techniques can be used to collect corrections to mispronunciations of words or phrases in text-to-speech applications and aggregate them in a central corpus. Game theory and other data validation techniques may then be applied to the corpus to validate the pronunciation corrections and generate a set of corrections with a high level of confidence in their validity and quality. Validated pronunciation corrections can also be generated for specific locales or particular classes of users, in order to support regional dialects or localized pronunciation preferences. The validated pronunciation corrections may then be provided back to the text-to-speech applications to be used in providing correct pronunciations of words or phrases to users of the application. Thus words and phrases may be pronounced in a manner familiar to a particular user or users in a particular locale, thus improving recognition of the speech produced and increasing confidence of the users in the application or system.

According to embodiments, a number of pronunciation corrections are received by a Web service. The pronunciation corrections may be provided by users of text-to-speech applications executing on a variety of user computer systems. Each of the plurality of pronunciation corrections includes a specification of a word or phrase and a suggested pronunciation provided by the user. The received pronunciation corrections are analyzed to generate validated correction hints, and the validated correction hints are provided back to the text-to-speech applications to be used to correct pronunciation of words and phrases in the text-to-speech applications.

It will be appreciated that the above-described subject matter may be implemented as a computer-controlled apparatus, a computer process, a computing system, or as an article of manufacture such as a computer-readable medium. These and various other features will be apparent from a reading of the following Detailed Description and a review of the associated drawings.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

The following detailed description is directed to technologies for providing validated text-to-speech correction hints from aggregated pronunciation corrections received from text-to-speech applications. While the subject matter described herein is presented in the general context of program modules that execute in conjunction with the execution of an operating system and application programs on a computer system, those skilled in the art will recognize that other implementations may be performed in combination with other types of program modules. Generally, program modules include routines, programs, components, data structures, and other types of structures that perform particular tasks or implement particular abstract data types. Moreover, those skilled in the art will appreciate that the subject matter described herein may be practiced with other computer system configurations, including hand-held devices, multiprocessor systems, microprocessor-based or programmable consumer electronics, minicomputers, mainframe computers, and the like.

In the following detailed description, references are made to the accompanying drawings that form a part hereof and that show, by way of illustration, specific embodiments or examples. In the accompanying drawings, like numerals represent like elements through the several figures.

Figure 1:
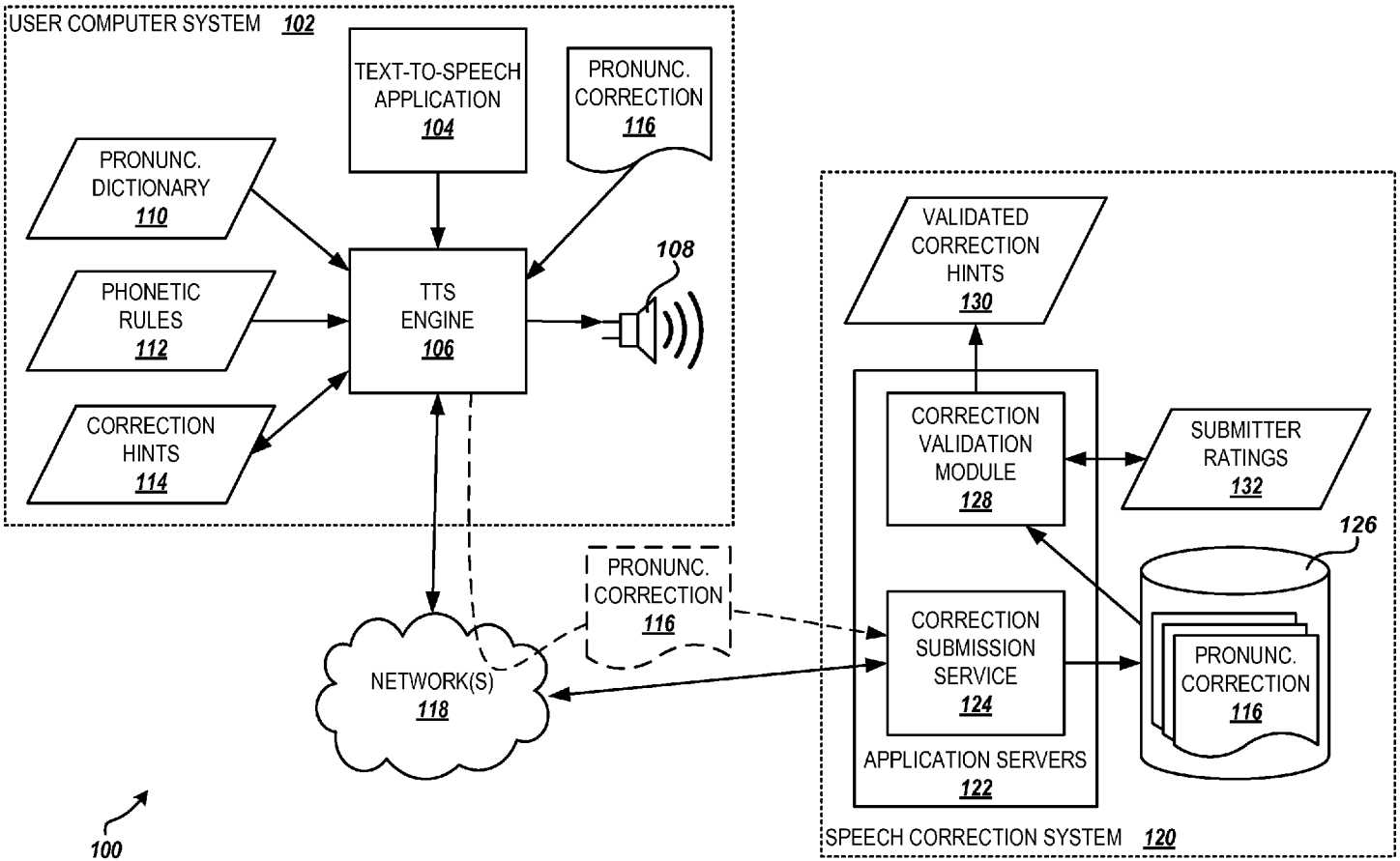
FIG. 1 is a block diagram showing aspects of an illustrative operating environment and software components provided by the embodiments presented herein.

FIG. 1 shows an illustrative operating environment 100 including software components for providing validated text-to-speech correction hints from aggregated pronunciation corrections received from text-to-speech applications, according to embodiments provided herein. The environment 100 includes a number of user computer systems 102. Each user computer system 102 may represent a user computing device, such as a global-positioning system ("GPS") device, a mobile phone, a personal digital assistant ("PDA"), a personal computer ("PC"), a desktop workstation, a laptop, a notebook, a tablet, a game console, a set-top box, a consumer electronics device, and the like. The user computer system 102 may also represent one or more Web and/or application servers executing distributed or cloud-based application programs and accessed over a network by a user using a Web browser or other client application executing on a user computing device.

According to embodiments, the user computer system 102 executes a text-to-speech application 104 that includes text-to-speech ("TTS") capabilities. For example, the text-to-speech application 104 may be a GPS navigation system that includes spoken "turn-by-turn" directions; a media player application that reads the title, artist, album, and other information regarding the currently playing media, a voice-activated communication system that reads text messages, email, contacts, and other communication related content to a user, a voice-enabled gaming system or social media application, and the like.

The TTS capabilities of the text-to-speech application 104 may be provided by a TTS engine 106. The TTS engine 106 may be a module of the text-to-speech application 104, or may be a text-to-speech service with which the text-to-speech application can communicate, over a network, for example. The TTS engine 106 may receive text comprising words and phrases from the text-to-speech application 104, which are converted to audible speech and output through a speaker 108 on the user computer system 102 or other device. In order to convert the text to speech, the TTS engine 106 may utilize a pronunciation dictionary 110 which contains many common words and phrases along with pronunciation rules for these words and phrases. Alternatively, or if a word or phrase is not found in the pronunciation dictionary 110, the TTS engine 106 may utilize phonetic rules 112 that allow the words and phrases to be parsed into "phonemes" and then converted to audible speech. It will be appreciated that the pronunciation dictionary 110 and/or phonetic rules 112 may be specific for a particular language, or may contain entries and rules for multiple languages, with the language to be utilized selectable by a user of the user computer system 102.

In some embodiments, the TTS engine 106 may further utilize correction hints 114 in converting the text to audible speech. The correction hints 114 may contain additional or alternative pronunciations for specific words and phrases and/or overrides for certain phonetic rules 112. With traditional text-to-speech applications 104, these correction hints 114 may be provided by a user of the user computer system 102. For example, after speaking a word or phrase, the TTS engine 106 or the text-to-speech application 104 may provide a mechanism for the user to provide feedback regarding the pronunciation of the word or phrase, referred to herein as a pronunciation correction 116. The pronunciation correction 116 may comprise a phonetic spelling of the "correct" pronunciation of the word or phrase, a selection of a pronunciation from a list of alternative pronunciations provided to the user, a recording of the user speaking the word or phrase using the correct pronunciation, or the like.

The pronunciation correction 116 may be provided through a user interface provided by the TTS engine 106 and/or the text-to-speech application 104. For example, after hearing a misspoken word or phrase, the user may indicate through the user interface that a correction is necessary. The TTS engine 106 or text-to-speech application 104 may visually and/or audibly provide a list of alternative pronunciations for the word or phrase, and allow the user to select the correct pronunciation for the word or phrase from the list. Additionally or alternatively, the TTS engine 106 and/or the text-to-speech application 104 may allow the user to speak the word or phrase using the correct pronunciation. The TTS engine 106 may further decode the spoken word or phrase to generate a phonetic spelling for the pronunciation correction 116. In another embodiment, the TTS engine 106 may then add an entry to the correction hints 114 on the local user computer system 102 for the corrected pronunciation of the word or phrase as specified in the pronunciation correction 116.

According to embodiments, the environment 100 further includes a speech correction system 120. The speech correction system 120 supplies text-to-speech correction services and other services to TTS engines 106 and/or text-to-speech applications 104 running on user computer systems 102 as well as other computing systems. In this regard, the speech correction system 120 may include a number of application servers 122 that provide the various services to the TTS engines 106 and/or the text-to-speech applications 104. The application servers 122 may represent standard server computers, database servers, web servers, network appliances, desktop computers, other computing devices, and any combination thereof. The application servers 122 may execute a number of modules in order to provide the text-to-speech correction services. The modules may execute on a single application server 122 or in parallel across multiple application servers in speech correction system 120. In addition, each module may comprise a number of subcomponents executing on different application servers 122 or other computing devices in the speech correction system 120. The modules may be implemented as software, hardware, or any combination of the two.

A correction submission service 124 executes on the application servers 122. The correction submission service 124 allows pronunciation corrections 116 to be submitted to the speech correction system 120 by the TTS engines 106 and/or the text-to-speech applications 104 executing on the user computer system 102 across one or more networks 118. According to embodiments, when a user of the TTS engine 106 or the text-to-speech application 104 provides feedback regarding the pronunciation of a word or phrase in a pronunciation correction 116, the TTS engine 106 or the text-to-speech application 104 may submit the pronunciation correction 116 to the speech correction system 120 through the correction submission service 124. The speech correction system 120 aggregates the submitted pronunciation corrections 116 and performs additional analysis to generate validated correction hints 130, as will be described in detail below.

The networks 118 may represent any combination of local-area networks ("LANs"), wide-area networks ("WANs"), the Internet, or any other networking topology known in the art that connects the user computer systems 102 to the application servers 122 in the speech correction system 120. In one embodiment, the correction submission service 124 may be implemented as a Representational State Transfer ("REST") Web service. Alternatively, the correction submission service 124 may be implemented in any other remote service architecture known in the art, including a Simple Object Access Protocol ("SOAP") Web service, a JAVA® Remote Method Invocation ("RMI") service, a WINDOWS® Communication Foundation ("WCF") service, and the like. The correction submission service 124 may store the submitted pronunciation corrections 116 along with additional data regarding the submission in a database 126 or other storage system in the speech correction system 120 for further analysis.

According to embodiments, a correction validation module 128 also executes on the application servers 122. The correction validation module 128 may analyze the submitted pronunciation corrections 116 to generate the validated correction hints 130, as will be described in more detail below in regard to FIG. 3. The correction validation module 128 may run periodically to scan all submitted pronunciation corrections 116, or the correction validation module may be initiated for each pronunciation correction received.

In some embodiments, the correction validation module 128 further utilizes submitter ratings 132 in analyzing the pronunciation corrections 116, as will be described in more detail below. The submitter ratings 132 may contain data regarding the quality, applicability, and/or validity of the pronunciation corrections 116 submitted by particular users of text-to-speech applications 104. The submitter ratings 132 may be automatically generated by the correction validation module 128 during the analysis of submitted pronunciation corrections 116 and/or manually maintained by administrators of the speech correction system 120. The submitter ratings 132 may be stored in the database 126 or other data storage system of the speech correction system 120.

Figure 2:
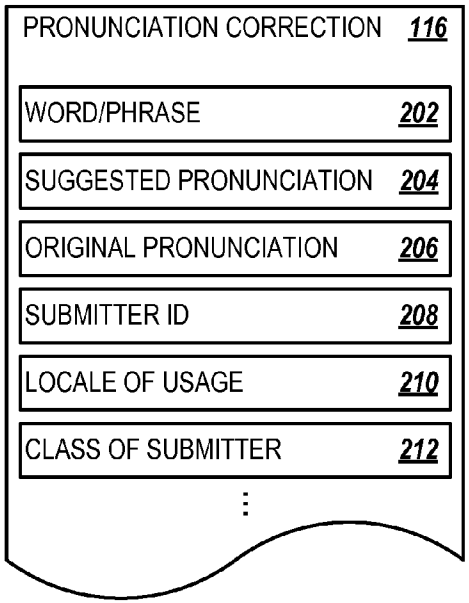
FIG. 2 is a data diagram showing one or more data elements included in a pronunciation correction, according to embodiments described herein.

FIG. 2 is a data structure diagram showing a number of data elements stored in each pronunciation correction 116 submitted to the correction submission service 124 and stored in the database 126, according to some embodiments. It will be appreciated by one skilled in the art that the data structure shown in the figure may represent a data file, a database table, an object stored in a computer memory, a programmatic structure, or any other data container commonly known in the art. Each data element included in the data structure may represent one or more fields in a data file, one or more columns of a database table, one or more attributes of an object, one or more member variables of a programmatic structure, or any other unit of data of a data structure commonly known in the art. The implementation is a matter of choice, and may depend on the technology, performance, and other requirements of the computing system upon which the data structures are implemented.

As shown in FIG. 2, each pronunciation correction 116 may contain an indication of the word/phrase 202 for which the correction is being submitted. For example, the word/phrase 202 data element may contain the text that was submitted to the TTS engine 106, causing the "mispronunciation" of the word or phrase to occur. The pronunciation correction 116 also contains the suggested pronunciation 204 provided by the user of the text-to-speech application 104. As discussed above, the suggested pronunciation 204 may comprise a phonetic spelling of the "correct" pronunciation of the word/phrase 202, a recording of the user speaking the word/phrase, and the like.

In one embodiment, the pronunciation correction 116 may additionally contain the original pronunciation 206 of the word/phrase 202 as provided by the TTS engine 106. The original pronunciation 206 may comprise a phonetic spelling of the word/phrase 202 as taken from the TTS engine's pronunciation dictionary 110 or the phonetic rules 112 used to decode the pronunciation of the word or phrase, for example. The original pronunciation 206 may be included in the pronunciation correction 116 to allow the correction validation module 128 to analyze the differences between the suggested pronunciation 204 and the original "mispronunciation" in order to generate more generalized validated correction hints 130 regarding words and phrases of the same origin, language, locale, and the like and/or the phonetic rules 112 involved in the pronunciation of the word or phrase.

The pronunciation correction 116 may further contain a submitter ID 208 identifying the user of the text-to-speech application 104 from which the pronunciation correction was submitted. The submitter ID 208 may be utilized by the correction validation module 128 during the analysis of the submitted pronunciation corrections 116 to lookup a submitter rating 132 regarding the user, which may be utilized to weight the pronunciation correction in the generation of the validated correction hints 130, as will be described below. In one embodiment, the text-to-speech applications 104 and/or TTS engines 106 configured to utilize the speech correction services of the speech correction system 120 may be architected to generate a globally unique submitter ID 208 based on a local identification of the user currently using the user computer system 102, for example, so that unique submitter IDs 208 and submitter ratings 132 may be maintained for a broad range of users utilizing a broad range of systems and devices and/or text-to-speech applications 104.

In another embodiment, the correction submission service 124 may determine a submitter ID 208 from a combination of information submitted with the pronunciation correction 116, such as a name or identifier of the text-to-speech application 104 and/or TTS engine 106, an IP address, MAC address, or other identifier of the specific user computer system 102 from which the correction was submitted, and the like. In further embodiments, the submitter ID 208 may be a non-machine specific identifier of a particular user, such as an email address, so that user ratings 132 may be maintained for the user based on pronunciation feedback provided by that user across a number of different user computer systems 102 and/or text-to-speech applications 104 over time. It will be appreciated that the text-to-speech applications may provide a mechanism for users to provide "opt-in" permission for the submission of personally identifiable information, such as a submitter ID 208 comprising an email address, IP address, MAC address, or other user-specific identifier, and that submission of personally identifiable information will only be submitted based on the user's opt-in permission.

The pronunciation correction 116 may also contain an indication of the locale of usage 210 for the word/phrase 202 from which the correction is being submitted. As will be described in more detail below, the validated correction hints 130 may be location specific, based on the locale of usage 210 from which the pronunciation corrections 116 were received. The locale of usage 210 may indicate a geographical region, city, state, country, or the like. The locale of usage 210 may be determined by the text-to-speech application 104 based on the location of the user computer system 102 when the pronunciation correction 116 was submitted, such as from a GPS location determined by a GPS navigation system or mobile phone. Alternatively or additionally, the locale of usage 210 may be determined by the correction submission service 124 based on an identifier of the user computer system 102 from which the pronunciation correction 116 was submitted, such as an IP address of the computing device, for example.

The pronunciation correction 116 may further contain a class of submitter 212 data element indicating one or more classifications for the user that submitted the correction. Similar to the locale of usage 210 described above, the validated correction hints 130 may alternatively or additionally be specific to certain classes of users, based on the class of submitter 212 submitted with the pronunciation corrections 116. The class of submitter 212 may include an indication of the user's language, dialect, nationality, location of residence, age, and the like. The class of submitter 212 may be specified by the text-to-speech application 104 based on a profile or preferences provided by the current user of the user computer system 102.

It will be appreciated that, as in the case of the user-specific submitter ID 208 described above, personally identifiable information, such as a location of the user or user computer system 102, nationality, residence, age, and the like may only be submitted and/or collected based on the user's opt-in permission. It will be further appreciated that the pronunciation correction 116 may contain additional data elements beyond those shown in FIG. 2 and described above that are utilized by the correction validation module 128 and/or other modules of the speech correction system 120 in analyzing the submitted pronunciation corrections and generating the validated correction hints 130.

Figure 3:
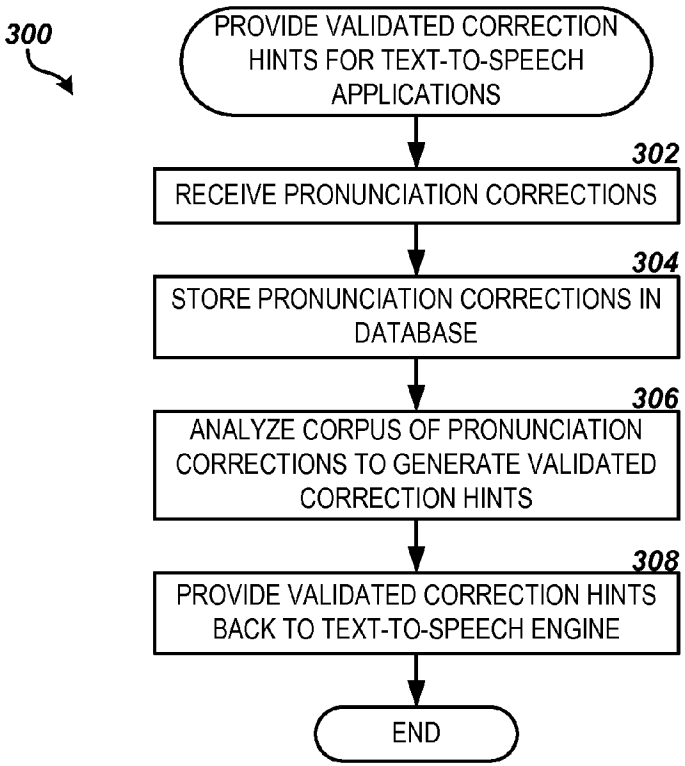
FIG. 3 is a flow diagram showing one method for providing validated text-to-speech correction hints from aggregated pronunciation corrections received from text-to-speech applications, according to embodiments described herein.

Referring now to FIG. 3, additional details will be provided regarding the embodiments presented herein. It should be appreciated that the logical operations described with respect to FIG. 3 are implemented (1) as a sequence of computer implemented acts or program modules running on a computing system and/or (2) as interconnected machine logic circuits or circuit modules within the computing system. The implementation is a matter of choice dependent on the performance and other requirements of the computing system. Accordingly, the logical operations described herein are referred to variously as operations, structural devices, acts, or modules. These operations, structural devices, acts, and modules may be implemented in software, in firmware, in special purpose digital logic, and any combination thereof. It should also be appreciated that more or fewer operations may be performed than shown in the figures and described herein. The operations may also be performed in a different order than described.

FIG. 3 illustrates one routine 300 for providing validated text-to-speech correction hints from aggregated pronunciation corrections 116 received from text-to-speech applications 104 and/or TTS engines 106, according to one embodiment. The routine 300 may be performed by the correction submission service 124 and the correction validation module 128 executing on the application servers 122 of the speech correction system 120, for example. It will be appreciated that the routine 300 may also be performed by other modules or components executing in the speech correction system 120, or by any combination of modules, components, and computing devices executing on the user computer systems 102 and or the speech correction system 120.

The routine 300 begins at operation 302, where the correction submission service 124 receives a number of pronunciation corrections 116 from text-to-speech applications 104 and/or TTS engines 106 running on one or more user computer systems 102. Some text-to-speech applications 104 and/or TTS engines 106 may submit pronunciation corrections 116 to the correction submission service 124 at the time the pronunciation feedback is received from the current user. As discussed above, the correction submission service 124 may be architected with a simple interface, such as a RESTful Web service, supporting efficient, asynchronous submissions of pronunciation corrections 116. Other text-to-speech applications 104 and/or TTS engines 106 may periodically submit batches of pronunciation corrections 116 collected over some period of time.

According to some embodiments, the correction submission service 124 is not specific or restricted to any one system or application, but supports submissions from a variety of text-to-speech applications 104 and TTS engines 106 executing on a variety of user computer systems 102, such as GPS navigation devices, mobile phones, game systems, in-car control systems, and the like. In this way, the validated correction hints 130 generated from the collected pronunciation corrections 116 may be based on a large number of users of many varied applications and computing devices, providing more data points for analysis and improving the quality of the of the generated correction hints.

The routine 300 proceeds from operation 302 to operation 304, where the correction submission service 124 stores the received pronunciation corrections 116 in the database 126 or other storage system in the speech correction system 120 so that they may be accessed by the correction validation module 128 for analysis. As described above in regard to FIG. 2, the correction submission service 124 may determine and include additional data for the pronunciation correction 116 before storing it in the database 126, such as the submitter ID 208, the locale of usage 210, and the like. The correction submission service 124 may store other data along with the pronunciation correction 116 in the database as well, such as a name or identifier of the text-to-speech application 104 and/or TTS engine 106 submitting the correction, an IP address, MAC address, or other identifier of the specific user computer system 102 from which the correction was submitted, a timestamp indicating when the pronunciation correction 116 was received, and the like.

From operation 304, the routine 300 proceeds to operation 306 where the correction validation module 128 analyzes the submitted pronunciation corrections 116 to generate validated correction hints 130. As discussed above, the correction validation module 128 may run periodically to scan all submitted pronunciation corrections 116 received over a period of time, or the correction validation module may be initiated for each pronunciation correction received. According to embodiments, some group of the submitted pronunciation corrections 116 are analyzed together as a corpus of data, utilizing statistical analysis methods, for example, to determine those corrections that are useful and/or applicable across some locales, class of users, class of applications, and the like versus those that represent personal preferences or isolated corrections. In determining the validated correction hints 130, the correction validation module 128 may look at the number of pronunciation corrections 116 submitted for a particular word/phrase 202, the similarities or variations between the suggested pronunciations 204, the differences between the suggested pronunciations 204 and the original pronunciations 206, the submitter ratings 132 for the submitter ID 208 that submitted the corrections, whether multiple, similar suggested pronunciations have been received from a particular locale of usage 210 or by a particular class of submitter 212, and the like.

For example, multiple pronunciation corrections 116 may be received for a particular word/phrase 202 with a threshold number of the suggested pronunciations 204 for the word/phrase being substantially the same. In this case, the correction validation module 128 may determine that a certain confidence level for the suggested pronunciation 204 has been reached, and may generate a validated correction hint 130 for the word/phrase 202 containing the suggested pronunciation 204. The threshold number may be a particular count, such as 100 pronunciation corrections 116 with substantially the same suggested pronunciations 204, a certain percentage of the overall submitted corrections for the word/phrase 202 having substantially the same suggested pronunciation, or any other threshold calculation known in the art as determined from the corpus to support a certain confidence level in the suggested pronunciation.

As described above, each pronunciation correction 116 may contain a locale of usage 210 for the word/phrase 202 from which the correction is being submitted. In another example, multiple pronunciation corrections 116 may be received for a word/phrase 202 of "Ponce de Leon," which may represent the name of a park or street in number of locations in the United States. Several pronunciation corrections 116 may be received from locale of usage 210 indicating San Diego, Calif. with one suggested pronunciation 204 of the name, while several others may be received from Atlanta, Ga. with a different pronunciation of the name. If the threshold number of the suggested pronunciations 204 for the word/phrase 202 is reached in one or both of the different locales of usage 210, then the correction validation module 128 may generate separate validated correction hints 130 for the word/phrase 202 for each of the locales, containing the validated suggested pronunciation 204 for that locale. The text-to-speech applications 104 and/or TTS engines 106 may be configured to utilize different validated correction hints 130 based on the current locale of usage 210 in which the user computer system 102 is operating, thus using proper local pronunciation of the name "Ponce de Leon" whether the user computer system is operating in San Diego or Atlanta.

Similarly, multiple pronunciation corrections 116 may be received for a word/phrase 202 having substantially the same suggested pronunciation 204 across different classes of submitter 212. The correction validation module 128 may generate separate validated correction hints 130 for the word/phrase 202 for each of the classes, containing the validated suggested pronunciation 204 for that class of submitter 212. The user of a user computer system 102 may be able to designate particular classes of submitter 212 *s* in their profile for the text-to-speech application 104, such as one or more of language, regional dialect, national origin, and the like, and the TTS engines 106 may utilize the validated correction hints 130 corresponding to the selected class(es) of submitter 212 when determining the pronunciation of words and phrases. Thus words and phrases may be pronounced in a manner familiar to that particular user, thus improving recognition of the speech produced and increasing confidence of the user in the application or system.

In further embodiments, the correction validation module 128 may consider the submitter ratings 132 corresponding to the submitter IDs 208 of the pronunciation corrections 116 in determining the confidence level of the suggested pronunciations 204 for a word/phrase 202. As discussed above, the submitter rating 132 for a particular submitter/user may be determined automatically by the correction validation module 128 from the quality of the individual user's suggestions, e.g. the number of accepted suggested pronunciations 204, a ratio of accepted suggestions to rejected suggestions, and the like. Additionally or alternatively, administrators of the speech correction system 120 may rank or score individual users in the submitter ratings 132 based on an overall analysis of received suggestions and generated correction hints. The correction validation module 128 may more heavily weight the suggested pronunciations 204 of pronunciation corrections 116 received from a user or system with a high submitter rating 132 in the determination of the threshold number or confidence level for a set of suggested pronunciations of a word/phrase 202 when generating the validated correction hints 130.

Additional validation may be performed by the correction validation module 128 and/or administrators of the speech correction system 120 to ensure that a group of pronunciation corrections 116 submitted for a particular word/phrase 202 represent actual linguistic or cultural corrections to the pronunciation of the word or phrase, and are not politically or otherwise motivated. For example, the name of a stadium in a particular city may be changed from its traditional name to a new name to reflect new ownership of the facility. A large number of users of text-to-speech applications 104 in the locale of the city, discontent with the name change, may submit pronunciation corrections 116 with a word/phrase 202 indicating the new name of the stadium, but suggested pronunciations 204 reflecting the old stadium name. Such situations may be identified by comparing the suggested pronunciations 204 with the original pronunciations 206 in the pronunciation corrections 116 and tagging those with substantial differences for further analysis by administrative personnel, for example.

In additional embodiments, the correction validation module 128 may analyze the differences between the suggested pronunciations 204 and original pronunciations 206 in a set of pronunciation corrections 116 for a particular word/phrase 202, a particular locale of usage 210, a particular class of submitter 212, and/or the like. The correction validation module 128 may utilize the analysis of the differences between the pronunciations 204, 206 to generate more generalized validated correction hints 130 regarding words and phrases of the same origin, locale, language, dialect, and the like in order and to update phonetic rules 112 for particular word origins, regional dialects, or the like.

From operation 306, the routine 300 proceeds to operation 308, where the generated validated correction hints 130 are made available to the TTS engines 106 and/or text-to-speech applications 104 executing on the user computer systems 102. In some embodiments, access to the validated correction hints 130 may be provided to the TTS engines 106 and/or text-to-speech applications 104 through the correction submission service 124 or some other API exposed by modules executing in the speech correction system 120. The TTS engines 106 and/or text-to-speech applications 104 may periodically retrieve the validated correction hints 130, or the validated correction hints may be periodically pushed to the TTS engines or applications on the user computer systems 102 over the network(s) 118.

The TTS engines 106 and/or text-to-speech applications 104 may store the new phonetic spelling or pronunciation contained in the validated corrections hints 130 in the local pronunciation dictionary 110 or with other locally generated correction hints 114. For pronunciation corrections regarding a particular locale of usage 210 or class of submitter 212, the TTS engines 106 and/or text-to-speech applications 104 may add entries to the local pronunciation dictionary 110 and/or correction hints 114 tagged to be used for words or phrases in the indicated locale or for users in the indicated class. More generalized validated correction hints 130 regarding words and phrases of the same origin, locale, language, dialect, and the like may also be stored in the correction hints 114 to be used to supplement or override the phonetic rules 112 for word or phrases for the indicated locales, regional dialects, or the like. Alternatively or additionally, developers of the TTS engines 106 and/or text-to-speech applications 104 may utilize the validated correction hints 130 to package updates to the pronunciation dictionary 110 and/or phonetic rules 112 for the applications which are deployed to the user computer systems 102 through an independent channel. From operation 308, the routine 300 ends.

Figure 4:
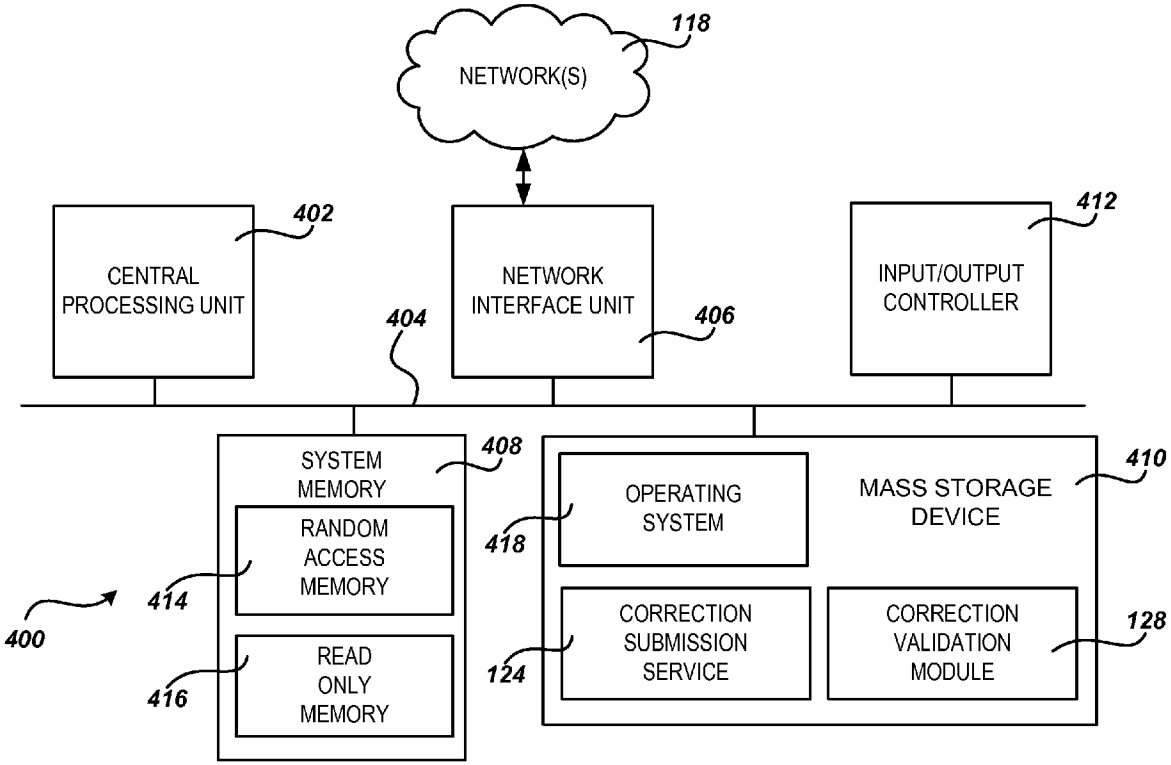
FIG. 4 is a block diagram showing an illustrative computer hardware and software architecture for a computing system capable of implementing aspects of the embodiments presented herein.

FIG. 4 shows an example computer architecture for a computer 400 capable of executing the software components described herein for providing validated text-to-speech correction hints from aggregated pronunciation corrections received from text-to-speech applications, in the manner presented above. The computer architecture shown in FIG. 4 illustrates a server computer, a conventional desktop computer, laptop, notebook, tablet, PDA, wireless phone, or other computing device, and may be utilized to execute any aspects of the software components presented herein described as executing on the applications servers 122, the user computer systems 102, and/or other computing devices.

The computer architecture shown in FIG. 4 includes one or more central processing units ("CPUs") 402. The CPUs 402 may be standard processors that perform the arithmetic and logical operations necessary for the operation of the computer 400. The CPUs 402 perform the necessary operations by transitioning from one discrete, physical state to the next through the manipulation of switching elements that differentiate between and change these states. Switching elements may generally include electronic circuits that maintain one of two binary states, such as flip-flops, and electronic circuits that provide an output state based on the logical combination of the states of one or more other switching elements, such as logic gates. These basic switching elements may be combined to create more complex logic circuits, including registers, adders-subtractors, arithmetic logic units, floating-point units, and other logic elements.

The computer architecture further includes a system memory 408, including a random access memory ("RAM") 414 and a read-only memory 416 ("ROM"), and a system bus 404 that couples the memory to the CPUs 402. A basic input/output system containing the basic routines that help to transfer information between elements within the computer 400, such as during startup, is stored in the ROM 416. The computer 400 also includes a mass storage device 410 for storing an operating system 418, application programs, and other program modules, which are described in greater detail herein.

The mass storage device 410 is connected to the CPUs 402 through a mass storage controller (not shown) connected to the bus 404. The mass storage device 410 provides non-volatile storage for the computer 400. The computer 400 may store information on the mass storage device 410 by transforming the physical state of the device to reflect the information being stored. The specific transformation of physical state may depend on various factors, in different implementations of this description. Examples of such factors may include, but are not limited to, the technology used to implement the mass storage device, whether the mass storage device is characterized as primary or secondary storage, and the like.

For example, the computer 400 may store information to the mass storage device 410 by issuing instructions to the mass storage controller to alter the magnetic characteristics of a particular location within a magnetic disk drive, the reflective or refractive characteristics of a particular location in an optical storage device, or the electrical characteristics of a particular capacitor, transistor, or other discrete component in a solid-state storage device. Other transformations of physical media are possible without departing from the scope and spirit of the present description. The computer 400 may further read information from the mass storage device 410 by detecting the physical states or characteristics of one or more particular locations within the mass storage device.

As mentioned briefly above, a number of program modules and data files may be stored in the mass storage device 410 and RAM 414 of the computer 400, including an operating system 418 suitable for controlling the operation of a computer. The mass storage device 410 and RAM 414 may also store one or more program modules. In particular, the mass storage device 410 and the RAM 414 may store the correction submission service 124 or the correction validation module 128, which were described in detail above in regard to FIG. 1. The mass storage device 410 and the RAM 414 may also store other types of program modules or data.

In addition to the mass storage device 410 described above, the computer 400 may have access to other computer-readable media to store and retrieve information, such as program modules, data structures, or other data. It should be appreciated by those skilled in the art that computer-readable media may be any available media that can be accessed by the computer 400, including computer-readable storage media and communications media. Communications media includes transitory signals. Computer-readable storage media includes volatile and non-volatile, removable and non-removable media implemented in any method or technology for the storage of information, such as computer-readable instructions, data structures, program modules, or other data. For example, computer-readable storage media includes, but is not limited to, RAM, ROM, EPROM, EEPROM, flash memory or other solid state memory technology, CD-ROM, digital versatile disks (DVD), HD-DVD, BLU-RAY, or other optical storage, magnetic cassettes, magnetic tape, magnetic disk storage or other magnetic storage devices, or any other medium that can be used to store the desired information and that can be accessed by the computer 400.

The computer-readable storage medium may be encoded with computer-executable instructions that, when loaded into the computer 400, may transform the computer system from a general-purpose computing system into a special-purpose computer capable of implementing the embodiments described herein. The computer-executable instructions may be encoded on the computer-readable storage medium by altering the electrical, optical, magnetic, or other physical characteristics of particular locations within the media. These computer-executable instructions transform the computer 400 by specifying how the CPUs 402 transition between states, as described above. According to one embodiment, the computer 400 may have access to computer-readable storage media storing computer-executable instructions that, when executed by the computer, perform the routine 300 for providing validated text-to-speech correction hints from aggregated pronunciation corrections received from text-to-speech applications described above in regard to FIG. 3.

According to various embodiments, the computer 400 may operate in a networked environment using logical connections to remote computing devices and computer systems through one or more networks 118, such as a LAN, a WAN, the Internet, or a network of any topology known in the art. The computer 400 may connect to the network(s) 118 through a network interface unit 406 connected to the bus 404. It should be appreciated that the network interface unit 406 may also be utilized to connect to other types of networks and remote computer systems.

The computer 400 may also include an input/output controller 412 for receiving and processing input from one or more input devices, including a keyboard, a mouse, a touchpad, a touch-sensitive display, an electronic stylus, a microphone, or other type of input device. Similarly, the input/output controller 412 may provide output to an output device, such as a computer monitor, a flat-panel display, a digital projector, a printer, a plotter, a speaker 108, or other type of output device. It will be appreciated that the computer 400 may not include all of the components shown in FIG. 4, may include other components that are not explicitly shown in FIG. 4, or may utilize an architecture completely different than that shown in FIG. 4.

Based on the foregoing, it should be appreciated that technologies for providing validated text-to-speech correction hints from aggregated pronunciation corrections received from text-to-speech applications are provided herein.

Although the subject matter presented herein has been described in language specific to computer structural features, methodological acts, and computer-readable storage media, it is to be understood that the invention defined in the appended claims is not necessarily limited to the specific features, acts, or media described herein. Rather, the specific features, acts, and mediums are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A system for providing validated text-to-speech correction hints to text-to-speech applications, the system comprising:

one or more application servers;

a correction submission service executing on the one or more application servers and comprising computer-executable instructions that cause the system to receive a plurality of pronunciation corrections, wherein each pronunciation correction of the plurality of pronunciation corrections comprises a specification of a single phrase, wherein the single phrase comprises at least a word, wherein each pronunciation correction of the plurality of pronunciation corrections also comprises a suggested pronunciation of the single phrase, wherein each pronunciation correction of the plurality of pronunciation corrections is provided by a user of one of the text-to-speech applications, and wherein each of the text-to-speech applications executes on a user computer system, and store the plurality of pronunciation corrections in a data storage system; and a correction validation module executing on the one or more application servers and comprising computer-executable instructions that cause the system to analyze the plurality of pronunciation corrections, generate a validated correction hint when a threshold number of pronunciation corrections are received for the single phrase, wherein each of the threshold number of pronunciation corrections comprises substantially similar suggested pronunciations of the single phrase, and provide the validated correction hint to each text-to-speech application, and thereby correcting, in each of the text-to-speech applications, a pronunciation of the single phrase.

2. The system of claim 1, wherein each pronunciation correction of the plurality of pronunciation corrections further comprises a specification of a single locale of usage, wherein the validated correction hint is generated for the single locale when another threshold number of pronunciation corrections are received for the phrase, and wherein each of the other threshold number of pronunciation corrections further comprises a substantially similar suggested pronunciation and further comprises the single locale of usage.

3. The system of claim 1, wherein each pronunciation correction of the plurality of pronunciation corrections further comprises a specification of a single class of submitter, wherein the validated correction hint is generated for the single class when another threshold number of pronunciation corrections are received for the phrase, and wherein each of the other threshold number of pronunciation corrections further comprises a substantially similar suggested pronunciation and further comprises the single class of submitter.

4. The system of claim 1, wherein each pronunciation correction of the plurality of pronunciation corrections further comprises a specification of a submitter, and wherein submitter ratings regarding a submitter are utilized in generating the validated correction hint.

5. The system of claim 1, wherein the correction submission service comprises a Web service.

6. A computer-implemented method for providing validated text-to-speech correction hints to text-to-speech applications, the method comprising:

receiving, from user computer systems, a plurality of pronunciation corrections, wherein each pronunciation correction of the plurality of pronunciation corrections is provided by a user of one of the text-to-speech applications;

analyzing the plurality of pronunciation corrections;

generating one or more validated correction hints; and providing the one or more validated correction hints to the text-to-speech applications, and thereby correcting, in each of the text-to-speech applications, one or more phrase pronunciations, wherein each of the phrase pronunciations corresponds to one of the one or more validated correction hints and is a pronunciation of at least one word.

7. The computer-implemented method of claim 6, wherein each pronunciation correction of the plurality of pronunciation corrections comprises a specification of a phrase and wherein each pronunciation correction of the plurality of pronunciation corrections also comprises a suggested pronunciation provided by a user.

8. The computer-implemented method of claim 7, wherein a validated correction hint of the one or more validated correction hints is generated when a confidence level for a suggested pronunciation is determined from a number of pronunciation corrections received for a same phrase.

9. The computer-implemented method of claim 7, wherein each pronunciation correction of the plurality of pronunciation corrections further comprises a specification of a locale of usage, and wherein a validated correction hint is generated for the locale when a confidence level for the suggested pronunciation is determined from a number of pronunciation corrections received for a same phrase, the same phrase having a same locale of usage as the specification of the locale of usage.

10. The computer-implemented method of claim 7, wherein each pronunciation correction of the plurality of pronunciation corrections further comprises a specification of a class of submitter, and wherein a validated correction hint is generated for the class when a confidence level for the suggested pronunciation is determined from a number of pronunciation corrections received for a same phrase, wherein the same phrase has a same class of submitter as the specification of the class of submitter.

11. The computer-implemented method of claim 7, wherein each pronunciation correction of the plurality of pronunciation correction further comprises a specification of a submitter, and wherein submitter ratings regarding submitters are utilized in determining a confidence level of a suggested pronunciation.

12. The computer-implemented method of claim 7, wherein each suggested pronunciation of the plurality of pronunciation corrections comprises a phonetic spelling of a phrase, and wherein each phonetic spelling is selected, by a user, from a list of alternate phonetic spellings of a phrase.

13. The computer-implemented method of claim 7, wherein a suggested pronunciation of the plurality of pronunciation corrections comprises a recording of a user speaking a phrase.

14. The computer-implemented method of claim 6, wherein the text-to-speech applications utilize the one or more validated correction hints to update local pronunciation dictionaries utilized by the text-to-speech applications.

15. The computer-implemented method of claim 6, wherein the plurality of pronunciation corrections are received from the text-to-speech applications through a Web service.

16. A computer-readable storage medium comprising one of an optical disk, a solid state storage device, or a magnetic storage device, wherein the optical disk, the solid storage device, or the magnetic storage device are encoded with computer-executable instructions that, when executed by a computer, cause the computer to:

receive a plurality of pronunciation corrections provided by users of text-to-speech applications, wherein each text-to-speech application comprises an application executing on a user computer system, wherein each pronunciation correction of the plurality of pronunciation corrections comprises a specification of a phrase, wherein the phrase comprises at least a word, and wherein each pronunciation correction of the plurality of pronunciation corrections also comprises a suggested pronunciation provided by a user;

store the plurality of pronunciation corrections in a data storage system;

analyze the plurality of pronunciation corrections;

generate one or more validated correction hints based, at least in part, on the plurality of pronunciation corrections; and provide the one or more validated correction hints to the text-to-speech applications, and thereby correcting, in each of the text-to-speech applications, one or more phrase pronunciations, wherein each of the phrase pronunciations corresponds to one of the one or more validated correction hints and is a pronunciation of at least one word.

17. The computer-readable storage medium of claim 16, wherein a validated correction hint is generated when a confidence level for a suggested pronunciation is determined from a number of pronunciation corrections received for a same phrase.

18. The computer-readable storage medium of claim 16, wherein each pronunciation correction of the plurality of pronunciation corrections further comprises a specification of a locale of usage, wherein a validated correction hint is generated for the locale when a confidence level for a suggested pronunciation is determined from a number of pronunciation corrections received for a same phrase, and wherein the same phrase has a same locale of usage as the specification of the locale of usage.

19. The computer-readable storage medium of claim 18, wherein the validated correction hint for the locale is utilized by a text-to-speech application to correct a pronunciation of a phrase, wherein a text-to-speech application is utilized, by a user, in the locale.

20. The computer-readable storage medium of claim 16, wherein each pronunciation correction of the plurality of pronunciation corrections further comprises a specification of a class of submitter, and wherein a validated correction hint is generated for the class of submitter when a confidence level for a suggested pronunciation is determined from a number of pronunciation corrections received for a same phrase, wherein the same phrase has a same class of submitter as the specification of the class of submitter.

* * * * *